US006866504B2

(12) United States Patent
Masi et al.

(10) Patent No.: US 6,866,504 B2
(45) Date of Patent: Mar. 15, 2005

(54) BURNER WITH HIGH-EFFICIENCY ATOMIZATION

(75) Inventors: Richard R. Masi, Perkiomenville, PA (US); Michael R. Thibou, Blandon, PA (US); Terry R. Schartel, Alburtis, PA (US)

(73) Assignee: MG Industries, Malvern, PA (US)

( * ) Notice: Subject to any disclaimer, the term of this patent is extended or adjusted under 35 U.S.C. 154(b) by 0 days.

(21) Appl. No.: 10/632,243

(22) Filed: Aug. 1, 2003

(65) Prior Publication Data

US 2005/0026099 A1 Feb. 3, 2005

(51) Int. Cl.[7] ..... F23C 7/00
(52) U.S. Cl. ..... 431/187; 431/354; 239/423
(58) Field of Search ..... 431/187, 131, 431/158, 354; 239/423, 424, 424.5

(56) References Cited

U.S. PATENT DOCUMENTS 3,680,999 A 8/1972 Hill
3,905,751 A 9/1975 Hemsath et al.
4,171,091 A * 10/1979 van Hardeveld et al. ..... 239/8
4,458,607 A 7/1984 Schoeber et al.
4,624,631 A 11/1986 Kobayashi et al.
5,199,866 A * 4/1993 Joshi et al. ..... 431/353
5,211,705 A 5/1993 Hagar
5,649,494 A 7/1997 Hufton
5,931,985 A 8/1999 Schoeler et al.
6,029,910 A * 2/2000 Joshi et al. ..... 239/404
6,233,974 B1 * 5/2001 Anderson et al. ..... 65/134.4
6,342,086 B1 1/2002 Shver
6,431,467 B1 8/2002 Joshi et al.

* cited by examiner

*Primary Examiner*—Alfred Basichas
(74) *Attorney, Agent, or Firm*—William H. Eilberg

(57) ABSTRACT

A burner has a nozzle formed of generally concentric inner and outer pieces. The inner piece defines a fuel conduit, and the outer piece defines an annular gas conduit which tapers down towards the outlet end of the nozzle. The inner piece has a rounded edge near the outlet end. The inner piece is longitudinally translatable, within a limited range of movement, relative to the outer piece, and can be locked into a desired position. The nozzle promotes efficient mixing of fuel and air (or oxygen) outside the burner. The stream of air creates a partial vacuum in the vicinity of the outlet end, serving to draw fuel out of the fuel conduit. Longitudinal adjustment of the inner piece allows the shape of the flame to be optimized. The burner can be used with virtually any fuel that can be provided in fluid form, whether solid, liquid or gas.

8 Claims, 3 Drawing Sheets

BURNER WITH HIGH-EFFICIENCY ATOMIZATION

BACKGROUND OF THE INVENTION

The present invention relates to the field of combustion, and provides a device which is capable of efficiently atomizing both gaseous and liquid media of varying viscosities, as well as fine fluidized solids.

The present invention provides a novel structure for improving the efficiency of combustion. Combustion efficiency is determined, in large part, by the thoroughness of the mixing of the fuel with oxygen or air. The burner of the present invention has a nozzle configuration that promotes such efficient mixing. In particular, the novel burner promotes thorough combustion due to the recirculation of gas by molecular entrainment outside the burner, due to the structure of the burner nozzle, and also due to the internal recirculation of gases within the tapered flow cone of the gas stream.

The nozzles used in the prior art can be categorized as "internal mix" or "external mix" nozzles. An internal mix nozzle is one in which the fuel and air are mixed inside the nozzle. In an external mix arrangement, the fuel and air mix outside the nozzle. Some systems of the prior art combine the features of both styles.

Internal mix nozzles have the advantage that they provide means for directly forcing the air and fuel to mix in a desired manner. An internal mix nozzle may have baffling, or other internal structures, for directing the air and fuel along predetermined paths, possibly tortuous ones, and especially under pressure, so as to cause the components to mix in a controlled and complete manner. Internal mix nozzles have the disadvantage that the structure that is useful for creating a tortuous path also creates resistance to fluid flow, and thus inherently induces a pressure drop. In general, an internal mix nozzle requires more energy to force the fuel and air streams through the nozzle, as compared with an external mix nozzle.

Another disadvantage of an internal mix nozzle is that fuel may flow backward into the oxygen or air conduit, or oxygen or air may flow backward into the fuel conduit, due to differences in pressure while in operation or from loss of pressure of either medium. Such unwanted flows can possibly cause unintended combustion or even an explosion. An external mix nozzle significantly reduces this problem, because the mixing occurs outside of the nozzle structure.

The fuel throughput achievable with an external mix nozzle is generally greater than what is obtainable from an internal mix structure, because of the fact that most external mix nozzles do not force the fuel or air to follow tortuous paths. That is, the back pressure associated with an external mix nozzle is generally less than that experienced with an internal mix nozzle. In addition, some external mix nozzles have an external "target", which is a barrier located beyond the nozzle tip, the target serving to redirect the pressurized stream of fuel and make it mix more efficiently with a pressurized stream containing oxygen and/or air. The target thus inherently impedes the flow of fuel, and increases the pressure drop of the nozzle, requiring additional pressure to force the fuel through the system. Also, the useful life of the burner is reduced due to heating of the target, and such a burner requires relatively exotic materials of construction.

In the prior art, internal mix nozzles have been used preferably for mixing a liquid with a gas, while external mix nozzles have been preferred for use in mixing gaseous media. An important advantage of the nozzle of the present invention is that it provides an external mix nozzle which is suitable for mixing virtually any combination of liquids and gases. Moreover, with the nozzle of the present invention, the need for pumping fuel under pressure is greatly reduced, while the fluid medium is still efficiently atomized.

SUMMARY OF THE INVENTION

The present invention includes a burner having a nozzle of the external mix type. The nozzle includes an inner conduit, adapted to be connected to a source of fuel, and an outer conduit, disposed generally concentrically around the inner conduit, and adapted to be connected to a source of air and/or oxygen. The outer conduit, defining an annular space, is tapered near the outlet end of the nozzle, such that the diameter of the outer conduit decreases towards the outlet end. The inner conduit of the nozzle is defined by a generally cylindrical inner piece that has a rounded edge in the vicinity of the outlet end. The taper of the outer conduit causes the air and/or oxygen to be directed towards the extended longitudinal axis of the nozzle, away from the tip of the burner. The rounded or radiused edge of the inner piece tends to cause the fuel to follow the contour of the rounded edge. This effect directs the fuel radially outward. Thus, the fuel is atomized by the vacuum effect of the stream containing air and/or oxygen at the inner cone of that stream, created at the outer edge of the nozzle tip, and the mixture is made to converge at a focal point, downstream of the nozzle, promoting thorough mixing and atomization of the fuel.

The jet of air and/or oxygen has the effect of creating a partial vacuum, in the vicinity of the outlet end of the nozzle, the vacuum serving to draw fuel out of the inner conduit. For this reason, the burner of the present invention requires substantially less pressure to advance the fuel through the system.

The inner piece of the nozzle is longitudinally adjustable, within a defined range. By moving the inner piece relative to a fixed outer piece, one changes the dimensions of the oxygen or air conduit, thereby changing the flow rate of the oxygen and/or air. This change modifies the fuel/air ratio, and adjusts the shape of the flame. A locking means, preferably located upstream of the nozzle, fixes the inner piece in a desired position.

The present invention therefore has the primary object of providing a burner for combusting fuel with air and/or oxygen.

The invention has the further object of providing an external mix burner nozzle that efficiently atomizes a liquid or a fluidized solid fuel.

The invention has the further object of providing a burner which minimizes the need for the use of pressure to push fuel through the burner.

The invention has the further object of enhancing the efficiency of a burner by providing a nozzle that promotes the thorough mixing of fuel and atomizing media.

The invention has the further object of providing a burner in which the configuration of the nozzle can be altered to optimize the shape of the flame.

The invention has the further object of providing a burner nozzle which effectively mixes virtually any mixture of fuel and atomizing media, whether the fuel is liquid, gaseous, or solid.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
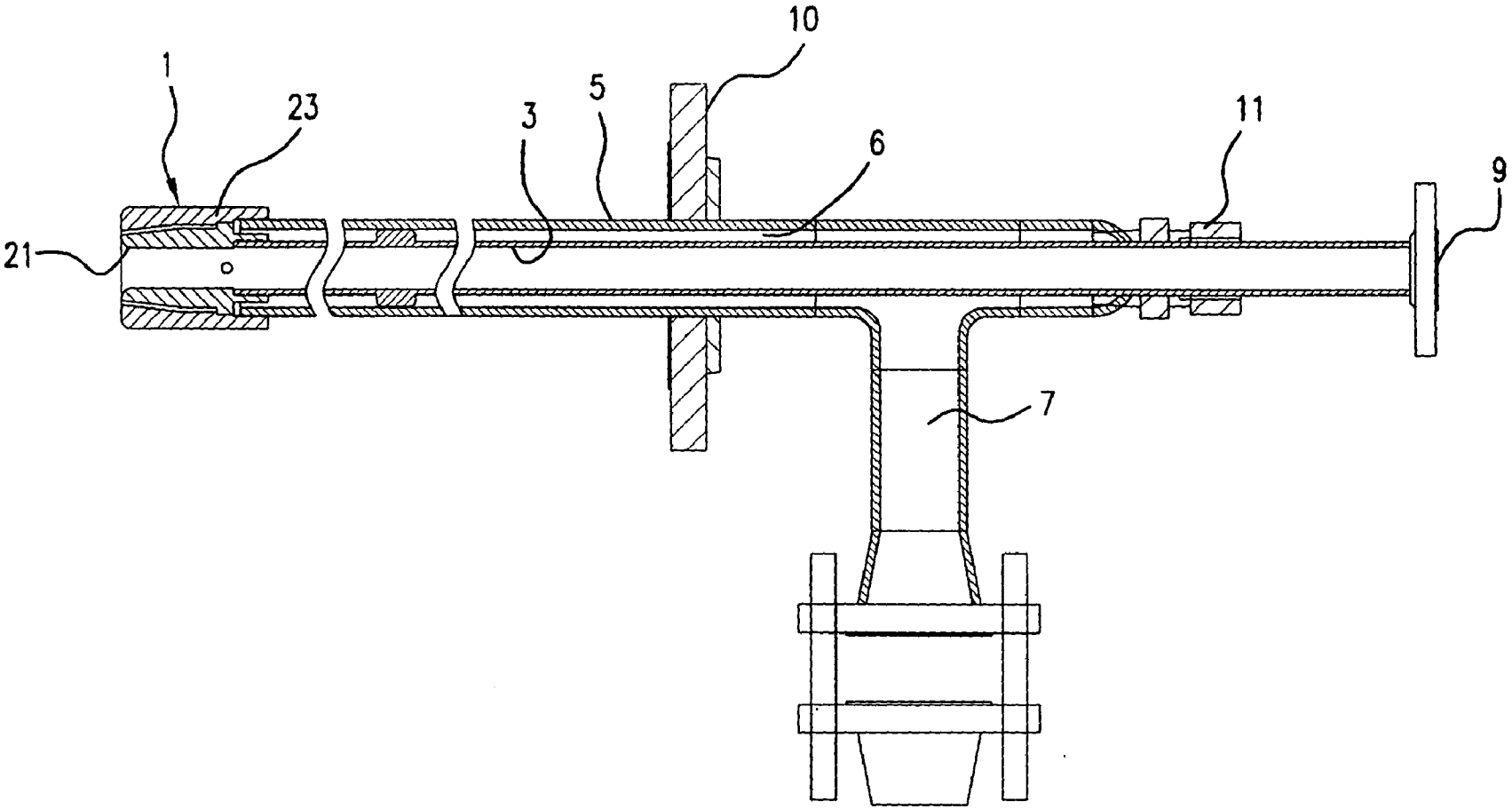
FIG. 1 provides a partially-fragmentary cross-sectional view of a burner of the present invention.

FIG. 1 provides a cross-sectional view of a burner made according to the present invention. The burner includes nozzle 1, the structure of which will be described in more detail below. The nozzle includes an inner piece 21 and an outer piece 23. The inner and outer pieces are mounted, respectively, to two concentric pipes, namely inner pipe 3, which defines a conduit for fuel flow, and outer pipe 5 which, together with inner pipe 3, defines an annular region 6 within which the atomizing media (usually air and/or oxygen) can flow. Preferably, the inner and outer pieces are screwed onto the respective pipes. In general, the inner and outer pipes are longer than the length of the nozzle. Moreover, as indicated in FIG. 1, the inner and outer pipes may be many times longer than the length of the nozzle.

Air or oxygen enters the system through conduit 7, which is in fluid communication with the annular region 6. Fuel is preferably introduced into inner pipe 3 at or near end plate 9. The pipes are held by support 10.

The fluid flowing in conduit 7 can be air, or oxygen, or any combination of air and oxygen, such as oxygen-enriched air. As used in this specification, the terms "air" or "oxygen" are intended to include all such combinations.

The inner pipe 3 is slidable, longitudinally, relative to the outer pipe 5. Because the inner pipe 3 is screwed to the inner piece 21, the inner piece and inner pipe move as a unit. The inner pipe and inner piece could be connected by other means, such as welding, within the scope of the invention. The burner normally includes a locking means 11, which can be a bored-through swage lock fitting, or other locking structure. The locking means holds the inner pipe, and thus the inner nozzle piece, in a selected position. The movement of the inner pipe and inner piece will be described in more detail below.

Figure 3:
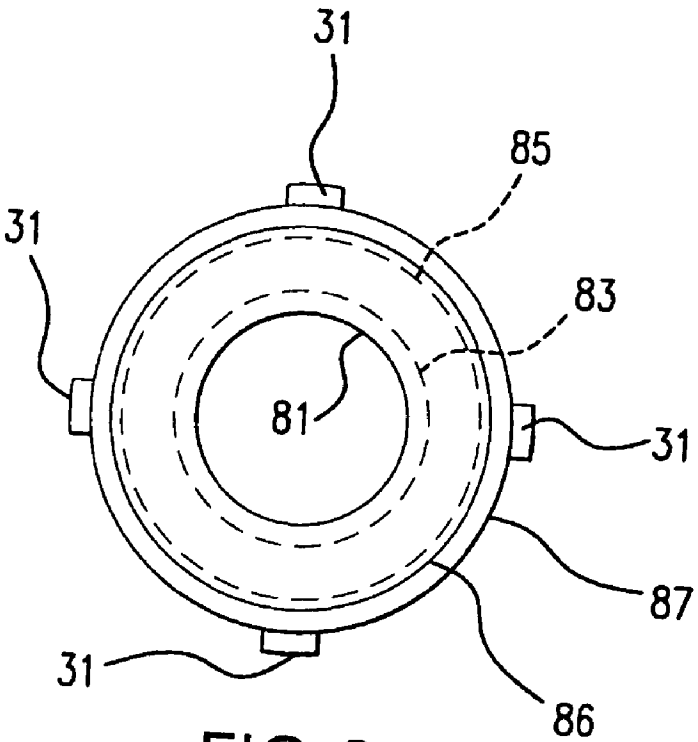
FIG. 3 provides a front end view similar to FIG. 2, but showing only the inner piece of the nozzle.
Figure 4:
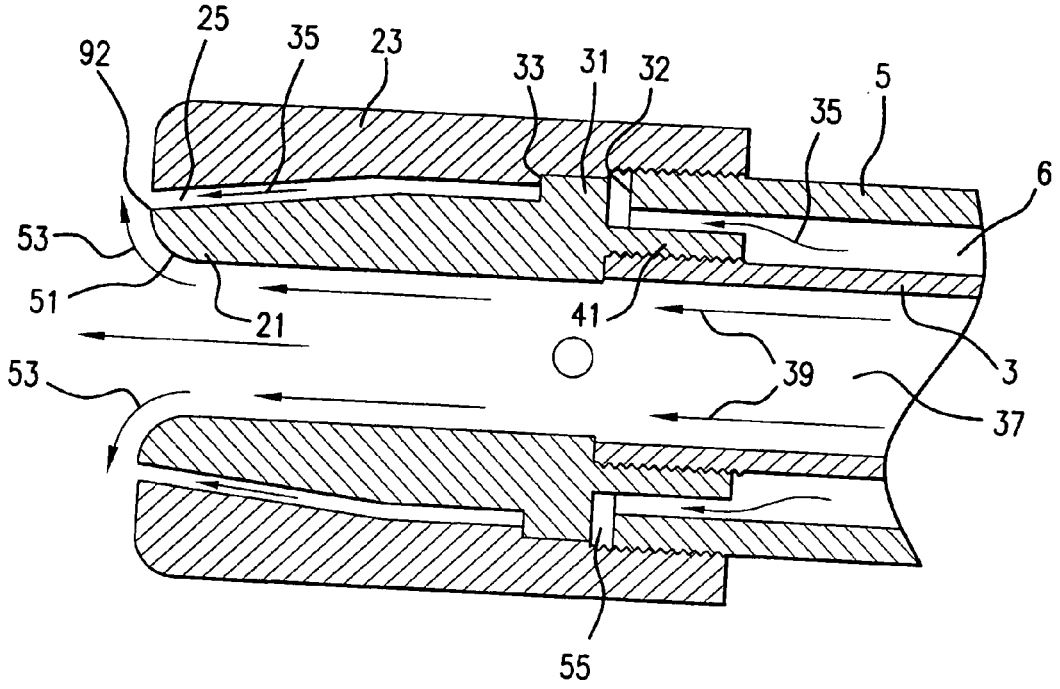
FIG. 4 provides a side view, in cross-section, of the burner nozzle of the present invention.
Figure 5:
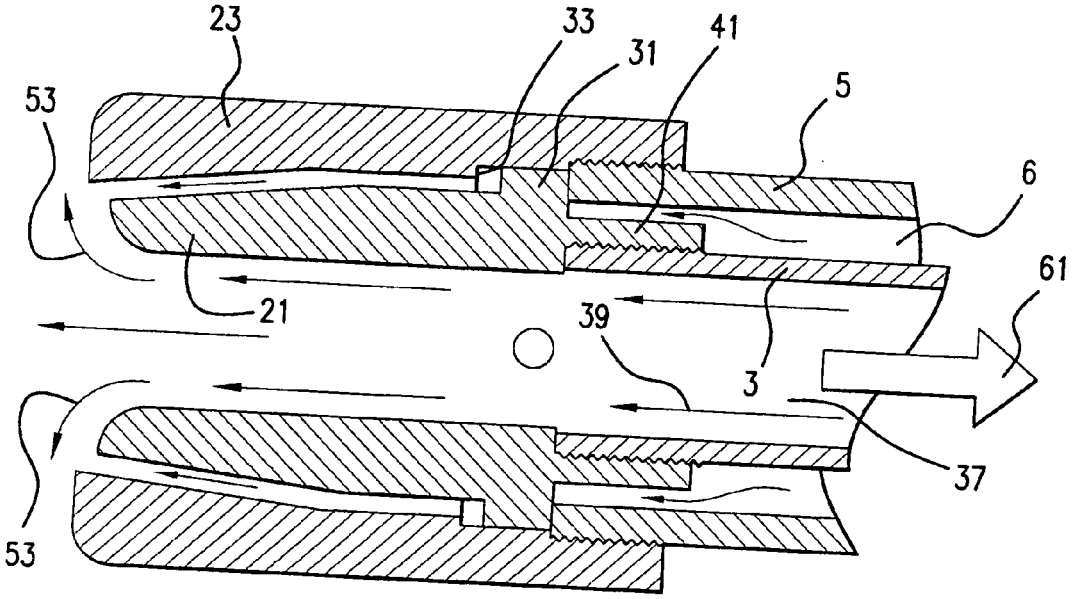
FIG. 5 provides a view similar to FIG. 4, wherein the inner piece of the nozzle has been retracted.

An important feature of the present invention is the structure of the nozzle, which is shown in more detail in FIGS. 4 and 5. Further details of the nozzle are shown in the end views of FIGS. 2 and 3, to be explained below.

As shown, for example, in FIG. 4, the nozzle includes inner piece 21 and outer piece 23. The inner piece is threadedly connected to inner pipe 3, and the outer piece is threadedly connected to outer pipe 5. As noted above, the threaded connections could be replaced by other means of connection.

The inner and outer pieces together define a tapered annular channel 25, that extends inward from the outlet end of the nozzle (the left-hand side in FIGS. 4 and 5), to a point where the channel becomes parallel to the longitudinal axis of the nozzle. In one preferred construction, the angle made by the tapered surface of the outer piece and the vertical forward end (as shown in the drawings) of the outer piece is about 83°. The amount of taper is dependent on the atomization needs of the application, and on parameters such as media viscosity. The amount of taper can be varied, within the scope of the invention. What is important is that the channel 25 direct air or oxygen out of the nozzle so that the fuel becomes molecularly entrained by the air or oxygen, and becomes atomized. The nozzle could be made with no taper at all, but it is believed that a nozzle with no taper would not be optimal.

The inner piece 21 has four pins or radial tabs or ribs 31 which engage a corresponding shoulder 33 defined by outer piece 23. The tabs 31 insure radial alignment of the inner piece relative to the outer piece, and also insure that the inner piece cannot move further forward (to the left in FIGS. 4 and 5) when the tabs abut the shoulder. The tabs 31 are also illustrated in FIG. 3, wherein it is apparent that the tabs are present only at discrete locations around the circumference of the inner piece. In the preferred embodiment, there are four tabs, but there could instead be a different number of tabs. Because the tabs are located only at discrete positions, the tabs do not interfere substantially with the flow of oxygen or air. The oxygen or air flows in the direction indicated by arrows 35. The fuel flows in the conduit 37, in the direction shown by arrows 39.

The rear portion 41 of inner piece 21, which is the portion of the inner piece that is threaded, has a reduced diameter, relative to the diameter of the inner piece in the vicinity of the tabs, so as to maintain a channel through which oxygen or air can flow.

The forward edge of the inner piece 21 is rounded, or internally radiused, at the location indicated by reference numeral 51. The rounded edge serves the following important function. The fuel flowing out of the channel 37, and near the inner boundary of that channel, tends to follow the curvature of the rounded edge, and therefore becomes directed outwardly, as indicated symbolically by arrows 53. The outward flow of at least some of the fuel, combined with the radially inward flow of the oxygen or air, caused by the tapered construction of the channel 25, insures that the two streams will collide with each other, outside the nozzle, and will mix thoroughly. It is believed that a non-tapered construction of channel 25 would still create such an effect, but to a much lesser degree.

An important feature of the invention is illustrated by the comparison of FIGS. 4 and 5. The shape of the flame can be controlled by varying the position of the inner piece 21 of the nozzle, relative to outer piece 23. For this reason, gap 55 is provided between the forward end 32 of outer pipe 5 and the rear portion of tabs 31, as shown in FIG. 4. This gap allows the assembly comprising the inner pipe 3 and the inner nozzle piece 21 to be withdrawn, i.e. moved to the right in FIGS. 4 and 5, by a distance of no more than the width of the gap. FIG. 5 shows the nozzle after the inner pipe and inner piece have been moved to the right, as indicated by arrow 61, to the maximum extent possible. In the view of FIG. 5, the gap has therefore disappeared, and another gap has been opened on the opposite side of the tabs.

When the inner piece is moved relative to the fixed outer piece, the dimensions of the oxygen or air conduit change, thereby causing a change in the flow rate of the oxygen or air. Thus, the fuel/air ratio is modified, causing a change in the shape of the flame.

The shoulder 33 and the forward end 32 of outer pipe 5 together define means for limiting the amount of longitudinal travel available to the inner piece.

FIGS. 4 and 5 therefore represent the extreme positions of the inner piece 21. The inner piece cannot move farther to the left than is shown in FIG. 4, and cannot move farther to the right than is shown in FIG. 5. The inner piece can, of course, assume any position between these two extremes.

Note that, in all cases, the inner piece 21 and the inner pipe 3 are moved as a unit, by longitudinal translation, and not by screwing or other changes to the threaded connection. Once the inner piece has been moved into an optimum position, as determined by the flame characteristic or other criteria, the position of the inner piece is fixed by a locking means, such as locking means 11 of FIG. 1.

Figure 2:
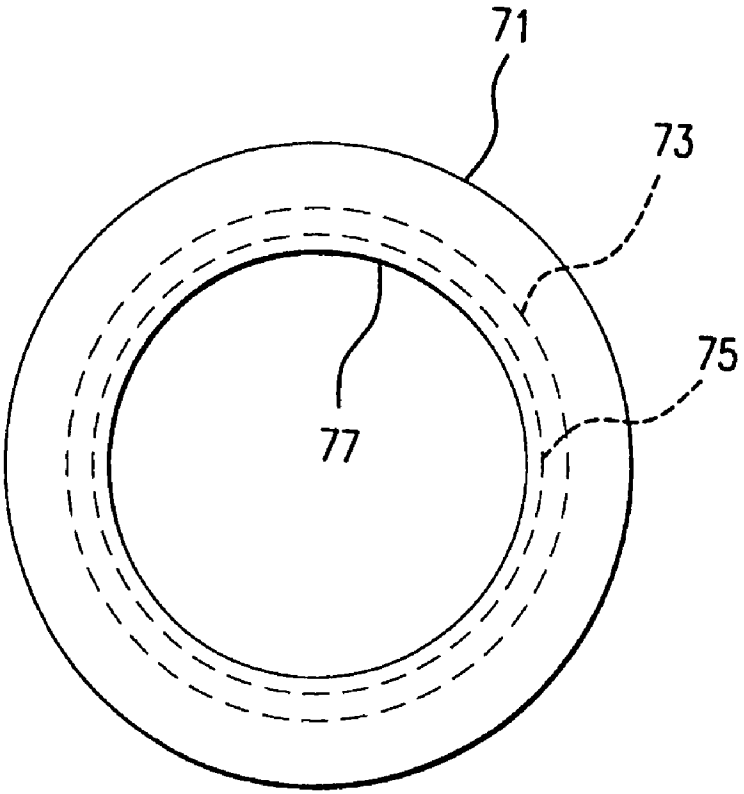
FIG. 2 provides a front end view of the outer piece of the nozzle of the burner of the present invention, as seen from the outlet end of the nozzle.

FIGS. 2 and 3 provide front end views showing further details of the construction of the nozzle. FIG. 2 provides a view of the outer piece of the nozzle, as seen from the outlet end, looking inward (i.e. to the right in FIG. 4), and without showing the inner piece, for clarity of illustration. Outer circle 71 represents the outermost edge of the outer piece 23 of the nozzle. Dashed circle 73 indicates the position of the shoulder 33 of FIG. 4. Dashed circle 75 represents the point at which the channel 25 transitions from a tapered to a non-tapered orientation. Circle 77 represents the inner diameter of the outer piece 23, at the outlet end of the nozzle.

FIG. 3 shows, in a front end view, the inner piece 21 of the nozzle, without showing the outer piece, for purposes of illustration. In FIG. 3, circle 81 represents the inside diameter of the inner piece 21, at the portion that comprises the beginning of the rounded portion indicated by reference numeral 51. Dashed circle 83 indicates the position of the threads located behind (i.e. upstream of) the tabs of the inner piece. Dashed circle 85 represents the outer extent of the reduced diameter rear portion 41 of the inner piece. Circle 86 represents the outer diameter of the sharp edge 92 of the rounded portion of the outlet end of the nozzle. Circle 87 represents the transition from the tapered portion of the inner piece to the non-tapered portion.

A prototype of the nozzle of the present invention has been made from the material known as Hastelloy C-276. A working nozzle has been made from Monel-400. Alternate materials of construction for the burner nozzle depend on the operating temperature of the furnace, and could be made from copper, ceramic, brass, or any other suitable material. The invention should not be deemed limited by the particular material selected. What is important is that the material be capable of withstanding the desired operating temperature.

Another feature of the present invention is the reduction of the need for pressure to propel the fuel through the system. The air or oxygen flowing out of the tapered channel, at high velocity, creates a partial vacuum, in the vicinity of the outlet end of the nozzle. The concentric nature of the tapered channel means that the jet of air or oxygen completely surrounds the fuel outlet. The partial vacuum created by the jet of air or oxygen draws the fuel out of the central conduit.

The nozzle of the present invention therefore differs from the prior art, in that the nozzle of the present invention can be considered to be vacuum-assisted, insofar as the partial vacuum reduces the need for propulsion of the fuel. In the present invention, some pressure may be needed to advance the fuel to the outlet end of the nozzle, but at that point, the vacuum effect begins, and does most of the work in moving the fuel through the system. In one test of the burner of the present invention, the nozzle was found to create sufficient vacuum to draw No. 2 diesel fuel oil out of a storage container, without requiring that the fuel be pumped. In practice, it is preferable to provide separate means for pumping the fuel, especially if it is desired to increase the fuel consumption or to change the stoichiometry of the fuel-air mixture.

In addition to its vacuum-assisted characteristic, the construction of the burner nozzle of the present invention is also believed to cause molecular entrainment of the fuel by the air or oxygen stream.

The nozzle of the present invention does not include a target, or external barrier, as is found in some of the external mix nozzles of the prior art.

The fuel and air streams largely converge at a focal point downstream of the tip or outlet end of the nozzle. Thus, the mixing of fuel and air occurs entirely outside of the nozzle, where the fuel tends to become atomized. The atomization is made more efficient, in part, by the tapered channel, which directs the air or oxygen radially inwardly, towards the focal point, and in part by the rounded forward edge of the inner piece of the nozzle, which causes the fuel to flow radially outwardly.

An advantage of the external mix structure of the nozzle of the present invention is that it tends to prevent fuel from flowing back into the air or oxygen line. Thus, the nozzle of the present invention creates a safer operating environment, by eliminating the possibility of back pressure against the fuel.

The structure of the nozzle of the present invention creates a pressure drop at its tip or outlet end. The external mixing of fuel and air, induced by the nozzle structure, helps to keep the nozzle temperature under control. The nozzle of the present invention can be considered to be inherently self-cooling, thus enhancing the useful life of the burner.

The burner of the present invention can be used with virtually any combination of types of fuel and air. As noted above, it can be used to mix gases with gases, or gases with liquids or solids. It is also useful with fuels having a wide range of viscosities. In fact, any combustible material, whether solid or gas, or any material that can burn in the presence of air or oxygen, and which can be made to act as a fluid, can be used in the burner of the present invention.

The burner of the present invention achieves complete, or nearly complete, combustion. The burner can be used as a heat source in a wide variety of industrial or other applications. The nozzle of the present invention could also be used as an atomizer or mixer in applications other than combustion.

The invention can be modified in various ways. The length and diameter of the various components, and the width of the annular channel, can be varied to accommodate the viscosity and BTU requirements of the fuel being used. The locking means 11 need not be a swage lock, but could be any other mechanism for fixing the inner pipe at a selected longitudinal position relative to the outer pipe. For example, one could use, instead of a swage lock, V-ring packing in a stuffing box with a gland, as will be understood by those skilled in the art. These and other modifications, which will be apparent to those skilled in the art, should be considered within the spirit and scope of the following claims.

What is claimed is:

1. A burner nozzle, comprising:

a) an inner conduit, and b) an outer conduit, the outer conduit being disposed generally concentrically around the inner conduit, the inner and outer conduits terminating in an outlet end, c) the outer conduit being tapered such that the outer conduit has a diameter which decreases towards the outlet end, d) the inner conduit being defined by a generally cylindrical inner piece which has inner and outer edges in a vicinity of the outlet end, the inner edge of the inner conduit being rounded, wherein the nozzle is free of any enclosure downstream of the outlet end, wherein fluids exiting the conduits at the outlet end mix in a region exterior to the nozzle.

2. The burner nozzle of claim 1, wherein the outer conduit is enclosed by a generally cylindrical outer piece, the outer piece having an inside surface, the inner piece having an outside surface, and wherein, in a vicinity of the outlet end, the inside surface of the outer piece and the outside surface of the inner piece are generally parallel.

3. A burner comprising the nozzle of claim 2, and wherein the inner piece is connected to an inner pipe having a length which exceeds a length of the inner piece, and wherein the outer piece is connected to an outer pipe having a length which exceeds a length of the outer piece, the inner piece and the inner pipe being longitudinally translatable within limits.

4. A burner nozzle, comprising:

a) an inner conduit, and b) an outer conduit, the outer conduit being disposed generally concentrically around the inner conduit, the inner and outer conduits terminating at an outlet end, c) the outer conduit being tapered such that the outer conduit has a diameter which decreases towards the outlet end, wherein the nozzle is free of any enclosure downstream of the outlet end, wherein fluids exiting the conduits at the outlet end mix in a region exterior to the nozzle, and wherein the outer conduit is enclosed by a generally cylindrical outer piece, the outer piece having an inside surface, wherein the inner conduit is defined by a generally cylindrical inner piece, the inner piece having an outside surface, and wherein, in a vicinity of the outlet end, the inside surface of the outer piece and the outside surface of the inner piece are generally parallel.

5. A burner comprising the nozzle of claim 4, and wherein the inner piece is connected to an inner pipe having a length which exceeds a length of the inner piece, and wherein the outer piece is connected to an outer pipe having a length which exceeds a length of the outer piece, the inner piece and the inner pipe being longitudinally translatable within limits.

6. A burner nozzle, comprising:

a) an inner piece and an outer piece, the outer piece being disposed concentrically around the inner piece, the inner piece defining a first fluid conduit, the inner and outer pieces together defining a region comprising a second fluid conduit surrounding said first fluid conduit, the inner and outer pieces terminating at an outlet end, b) wherein the inner piece has an outer surface, and wherein the outer piece has an inner surface, and wherein the outer surface of the inner piece and the inner surface of the outer piece are generally parallel to each other in a vicinity of the outlet end, and c) wherein the nozzle is free of any enclosure downstream of the outlet end, wherein fluids exiting the first and second conduits at the outlet end mix in a region exterior to the nozzle.

7. The nozzle of claim 6, wherein the inner piece has inner and outer edges, and wherein the inner edge of the inner piece is rounded in a vicinity of the outlet end.

8. A burner nozzle, comprising:

a) an inner piece and an outer piece, the outer piece being disposed concentrically around the inner piece, the inner piece defining a first fluid conduit, the inner and outer pieces together defining a region comprising a second fluid conduit surrounding said first fluid conduit, the inner and outer pieces terminating at an outlet end, b) wherein the inner piece has inner and outer edges, and wherein the inner edge of the inner piece is rounded in a vicinity of the outlet end, and c) wherein the nozzle is free of any enclosure downstream of the outlet end, wherein fluids exiting the first and second conduits at the outlet end mix in a region exterior to the nozzle.

* * * * *